United States Patent [19]

Dörr, deceased et al.

[11] Patent Number: 4,759,657

[45] Date of Patent: Jul. 26, 1988

[54] METHOD AND A DEVICE FOR CONTROLLING THE VERTICAL ADJUSTMENT OF A LEVELLING PLANK

[75] Inventors: Paul Dörr, deceased, late of Ketsch, by Magda Dörr, legal representative; Roland Grundl, Heiligkreuzsteinach; Alfred Ulrich, Ladenburg, all of Fed. Rep. of Germany

[73] Assignee: Joseph Vögele AG, Mannheim, Fed. Rep. of Germany

[21] Appl. No.: 914,450

[22] Filed: Oct. 2, 1986

[30] Foreign Application Priority Data

Oct. 3, 1985 [DE] Fed. Rep. of Germany ..... 3535362

[51] Int. Cl.[4] ..... E01C 19/42

[52] U.S. Cl. ..... 404/72; 404/84; 404/118

[58] Field of Search ..... 404/84, 96, 101, 102, 404/118, 72; 37/108 R, DIG. 1, DIG. 13, DIG. 20

[56] References Cited

U.S. PATENT DOCUMENTS 4,026,658 5/1977 Neuendorf et al. ..... 404/84

FOREIGN PATENT DOCUMENTS 2333371 1/1975 Fed. Rep. of Germany .

975862 11/1982 U.S.S.R. ..... 404/101

OTHER PUBLICATIONS

Barber-Greene publication, "Automatic Screed Control Systems for Asphalt Finishers", Apr. 30, 1970.

Barber-Greene publication, "Model SB-50, Rubber-Tired Finisher", Apr. 30, 1970.

*Primary Examiner*—Stephen J. Novosad
*Assistant Examiner*—John F. Letchford
*Attorney, Agent, or Firm*—Finnegan, Henderson, Farabow, Garrett & Dunner

[57] ABSTRACT

The present invention refers to a method for controlling the vertical adjustment of a levelling and compacting plank drawn by a road-construction machine. During the working procedure the level of the plank, which is in floating contact with the material, is adjusted automatically. The present invention aims at preventing undesirable lifting of the plank caused by material which is located ahead of the plank and the flowability of which was changed due to an interruption in the motion of the machine. Hence, the invention employs the feature that, when the travelling mechanism is switched on, lifting of the plank, which is blocked against lowering when the machine is standing still, is blocked as well and that the blocking is eliminated only after a predetermined period of time.

6 Claims, 2 Drawing Sheets

METHOD AND A DEVICE FOR CONTROLLING THE VERTICAL ADJUSTMENT OF A LEVELLING PLANK

FIELD OF THE INVENTION

The present invention relates to a travelling road construction machine for depositing paving material and to a method for operation thereof.

DESCRIPTION OF THE PRIOR ART

By means of travelling road construction machines, it is possible to apply granular and asphalt-bonded or cement-bonded paving materials with various flowabilities in the desired thickness. The thickness of the layer is essentially determined by the inclination of the plank relative to the substratum and by its travelling speed in combination with the flow and compacting behaviour of the construction material. The measure of monitoring the work result during the working procedure by appropriate measuring instruments is known, and it is also known to adjust the level of the plank in an appropriate manner, if necessary. When the machine is standing still, this vertical movability of the floating suspension is locked downwards in such a way that the plank cannot swing below the predetermined level. This is important particularly in cases in which a temporary stop becomes necessary during one work motion, e.g. due to an interruption in the supply of material. In the case of the known method, the vertical blocking is eliminated when the machine recommences to travel, the plank is again in floating contact with the construction material. It will then first come into contact with construction material, which was positioned in front of the plank directly prior to the interruption of the travelling motion. Depending on the type of material and on the period of standstill, the flowability may have changed due to cooling down in such a way that, when the forward movement of the plank recommences, said plank will meet with increased accumulation resistance and will be lifted up. When, in the course of the continued travelling motion, the plank reaches construction material having a normal temperature and a normal flowability, it will be floatingly readjusted to its normal level. The difference in the layer thicknesses which has been caused in the starting area is clearly visible and has to be levelled out by a complicated subsequent treatment.

Attempts have already been made to avoid vertical adjustment defects upon starting of the machine by manually introduced control movements of the vertical adjustment of the plank. This has turned out to be complicated and not very promising.

SUMMARY OF THE INVENTION

It is a primary object of the present invention to provide a travelling paving machine and method of operation in which paving defects and irregularities are prevented during the period of initial start-up.

During starting of the machine, the plank, whose vertical movements are blocked in both directions, defines with its suspension members on the road construction machine a rigid system having a fixed plank position. Even in the case of an increased accumulation resistance, the plank cannot move upwards. On the basis of said rigid system, the plank is also capable of overcoming the increased accumulation resistance, i.e. it is capable of stripping projecting material. Just as automatically as the blocking occurs when the travelling motion starts, it is eliminated after expiration of the predetermined period of time, i.e. the floating position of the plank is reestablished. The period of time should be selected in accordance with the respective operating conditions, i.e. in accordance with the stretch of road which will presumably be covered with material ahead of the plank upon interruption of the travelling motion and in accordance with the starting acceleration and the speed of the road-construction machine. These values result from the constructional features of the road-construction machine and of the plank, and perhaps also from the paving material used. Hence, it will not be difficult to choose a period of time guaranteeing a largely uniform layer thickness also in the case of intermediate stops in the travelling motion.

In the case of a method which employs the measure of controlling the level of the plank by a height levelling means in accordance with a reference line in the course of the working procedure, one embodiment of the invention provides, during the starting operation, levelling motions are not carried out—neither any upward nor any downward levelling motions. It follows that the levelling means does not have applied thereto any loads due to the increased accumulation resistances, but is part of the rigid system.

Another embodiment of the invention provides for exact levelling and compacting work of the plank after expiration of the selected period of time. A transitional range in which movable members could act on members which are still blocked does not exist between the rigid vertical adjustment and the adjustable, floating position of contact.

The present invention also provides a device for carrying out the method for a levelling and compacting plank which is articulated on the road-construction machine by means of connection members acted upon by levelling cylinders for angular adjustment and for vertical adjustment and which is suspended by means of lift cylinders for floating mounting; for the floating-contact operating position, said lift cylinders are to be kept open via a system of conduits and valves at the lift as well as at the pressure side. In accordance with an embodiment of the invention, the vertical blocking of the plank in the starting period—which is provided in accordance with the invention—is effected via a control member which is adapted to be acted upon by the switch for the travelling mechanism and which blocks the supply and the discharge conduits of the lift cylinders by means of valves, whereby said lift cylinders are disabled. Switching to the floating position is effected by means of a timing element after expiration of the selected period of time.

During the selected period of time, the levelling means and the lift cylinder define a rigid unit whose vertical level is fixed, and, subsequently, they have simultaneously imparted thereto their normal operating movability.

In accordance with an embodiment of the invention, a pressure relief valve prevents damage to the lift cylinders and/or the plank in extreme cases, i.e. if in the case of a particularly long period of standstill the construction material hardens and/or if said construction material should be piled up to an abnormally high level.

BRIEF DESCRIPTION OF THE DRAWINGS

In the following, the method according to the invention will be described on the basis of an embodiment of a device according to the invention with reference to the respective drawings, in which.

DESCRIPTION OF THE PREFERRED EMBODIMENT

Figure 1:
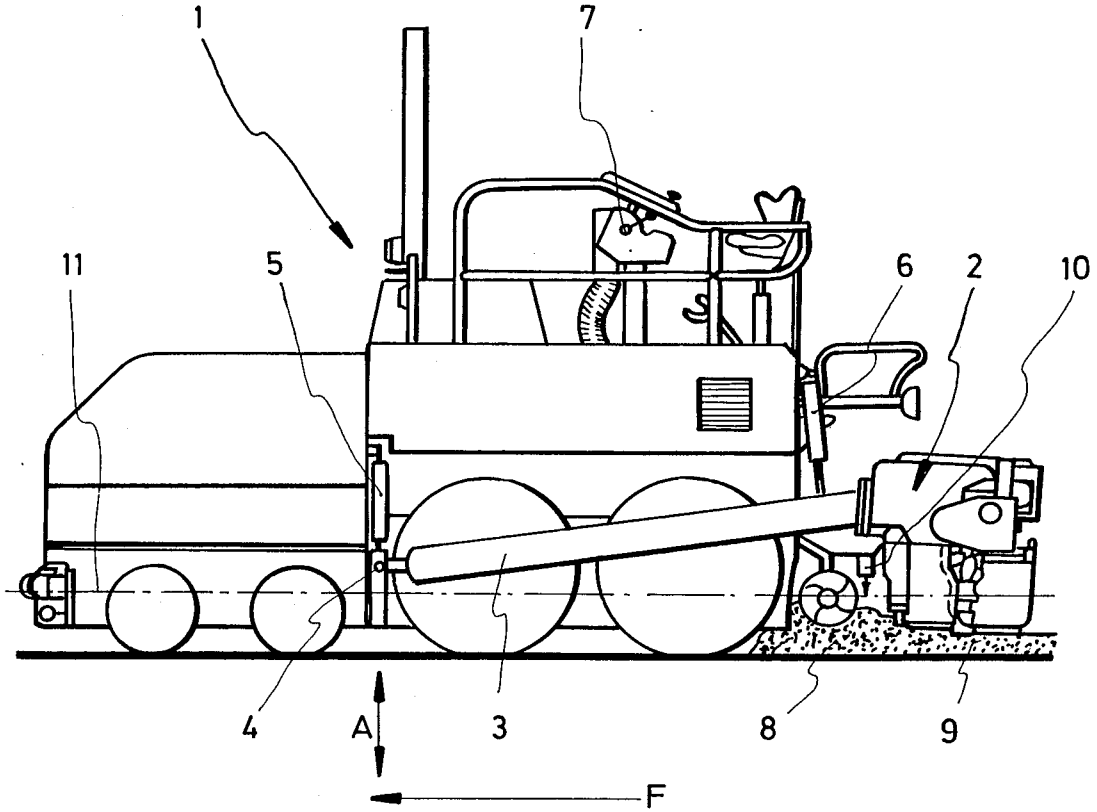
FIG. 1 shows a road-construction machine having attached thereto a levelling and compacting plank during a working procedure and FIG. 2 shows an electric and hydraulic circuit diagram of a blocking means.

A road-construction machine, which is, as a whole, provided with reference numeral 1, has attached thereto a levelling and compacting plank 2. The connection between the plank 2 and the construction machine 1 is established by connecting rods 3, the free end of each of said connecting rods being secured to a respective attachment point 4 which is provided at the side of the road-construction machine. Each of the attachment points 4 can be vertically adjusted in the direction of the double arrow A by means of levelling cylinders 5. Furthermore, at the rear end of the road-construction machine 1 lift cylinders 6 are arranged which act on the connecting rods 3 in the vicinity of the plank 2. The lift cylinders 6 produce a double effect.

When a working procedure is being carried out, the road-construction machine 1 moves in the travelling direction indicated by arrow F after actuation of a traction switch 7. In the course of this process, paving material 8 is deposited ahead of the plank, when seen in the direction of motion, and by means of stripping and compacting said plank forms a layer 9 of desired thickness of said paving material. In so doing, the plank moves in floating contact with the paving material 8 and is held by the lift cylinders 6 which are open in both directions, i.e. with the pistons moving freely upwards and downwards.

The desired layer thickness is monitored by a measuring device 10, which is arranged on the road-construction machine in the vicinity of the plank 2 and which compares the plank level with a predetermined reference line 11. If any deviations occur, the measuring device acts on the levelling cylinders 5. These levelling cylinders, in turn, displace the attachment points 4 upwards or downwards. This has the effect that the inclination of the plank 2 is changed via the connecting rods 3.

If the travelling motion of the road-construction machine is interrupted, i.e. if the traction switch 7 is deactuated, the plank lowering movement is prevented by means of suitable blocking of the lift cylinders 6.

Figure 2:
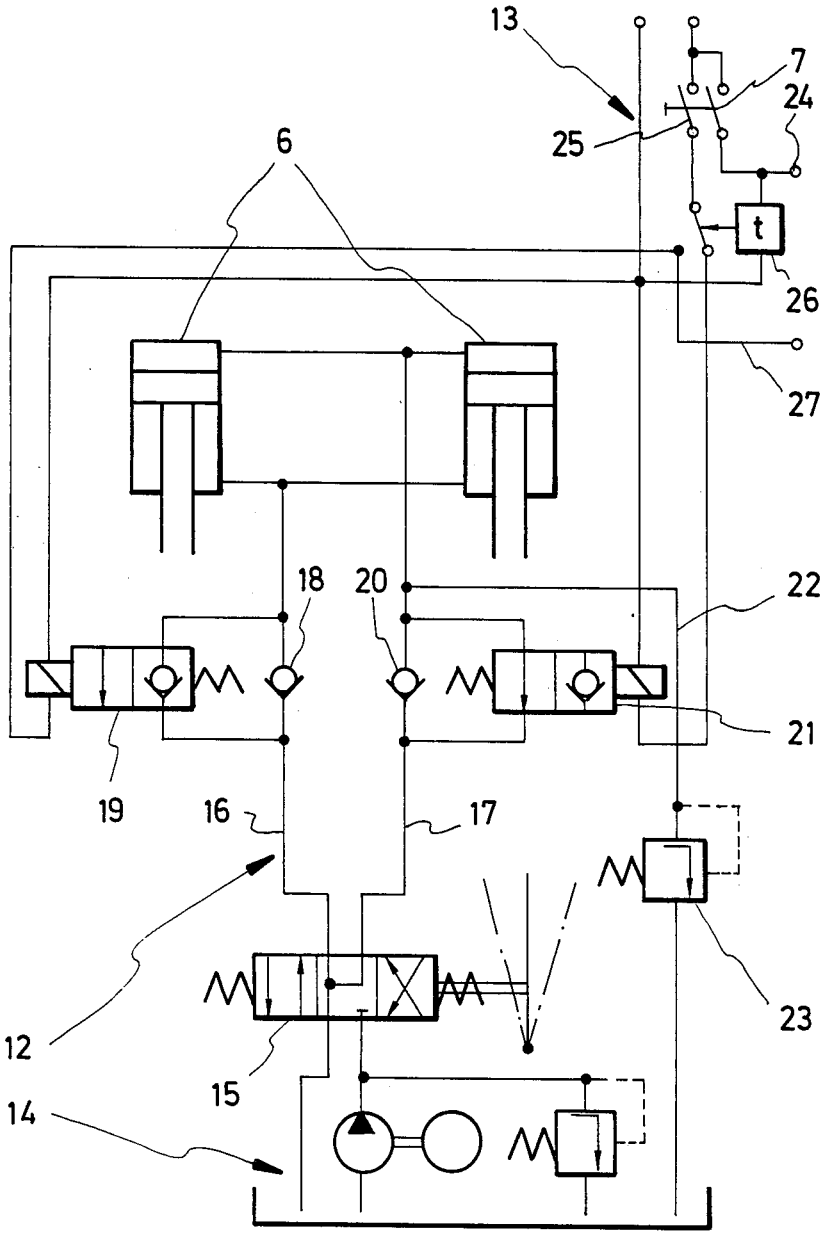

FIG. 2 shows in a schematized representation a system of hydraulic conduits and valves, which, as a whole, is provided with reference numeral 12, as well as the electric control circuit 13 of said system. In a hydraulic system 14, the lift cylinders 6 are connected via a four/three-way valve 15, a lift conduit 16 and a lowering conduit 17. The lift conduit 16 has arranged therein a non-return valve 18, and a two/two-way valve 19 is connected in parallel thereto. The lowering conduit 17 has provided therein a non-return valve 20, and a two/two-way valve 21 is connected in parallel thereto. In addition, a discharge conduit 22 branches off the lowering conduit 17 at a point between the valves and the lift cylinders 6, said discharge conduit 22 leading to a pressure relief valve 23.

The electric control circuit 13 is adapted to be acted upon by the traction switch 7. In response to an actuation of the traction switch 7, a pulse line 24 for the travelling mechanism is switched on the one hand. On the other hand, the valves are actuated via a control member 25. Moreover, a timing element 26 is acted upon.

The mode of operation of the described system of hydraulic conduits and valves as well as of the electric control circuit associated therewith will be explained hereinbelow.

FIG. 2 shows the position of rest, i.e. the traction switch 7 is not closed, the road-construction machine stands still. In this position, the two/two-way valve 19 in the lift conduit 16 is closed. The hydraulic fluid cannot flow back from the piston-rod side of the cylinder to the hydraulic system, i.e. the lowering motion of the pistons and, consequently, a downwardly directed change in the position of the plank are blocked. The two/two-way valve 21 in the lowering conduit 17 is open.

When work is being started, the traction switch 7 is switched to its closed position. It starts the travelling mechanism via the pulse line 24. At the same time, it actuates the control member 25. Said control member, in turn, switches the two/two-way valve 21 in the lowering conduit 17 to the blocking position. This has the effect that the lift cylinders 6 are blocked in both directions of movement and, consequently, the plank 2 is blocked as well. Simultaneously with these switching operations, a levelling means, which is not shown, was blocked via a pulse line 27, said levelling means controlling the adjustment motions of the levelling cylinders 5. It follows that all changes in the position of the plank 2 are prevented while the machine is being started. The timing element 26 was acted upon simultaneously with the switching of the traction switch. After expiration of a predetermined period of time, the timing element 26 in the electric control circuit 13 switches over in such a way that the two/two-way valve 19 as well as the two/two-way valve 21 are switched to free passage. This has the effect that the lift cylinders 6 are released in both directions of movement, the plank is supported in a floating manner. At the same time, the blocking of the levelling cylinders is eliminated via the pulse line 27. The switching operations described guarantee that, during a specific starting period of the road construction machine, the plank defines together with the connecting rods 3 and the lift cylinders 6 a system which is rigidly connected to the road-construction machine 1 and which does not permit any changes in level.

It follows that the plank cannot be forced upwards by paving material which was deposited ahead of the plank prior to the standstill of the road-construction machine and the flowability of which was impaired due to cooling down during the period of standstill. Level defects in the layer 9 are thus avoided. The subsequently following simultaneous release of the levelling means and of the lift cylinder motion causes a smooth transition to the normal working process.

The present invention is not limited to the embodiment. The essential point is that, during a specific starting period, the vertically directed movements of the plank are automatically blocked and that, subsequently, full release of these movements is automatically effected. The way in which this blocking is effected and its control essentially depend on the structural design of the means for attaching and suspending the plank and on the actuation and control means thereof.

We claim:

1. A method for controlling the vertical adjustment of a levelling and compacting plank of a travelling road-construction machine, said method comprising preventing upward and downward movement of said plank for a predetermined period of time from initial operation of said machine, thereafter maintaining said compacting plank in floating contact with a layer of flowing paving material during continued operation of said machine and preventing downward movement of said compacting plank when operation of said machine stops.

2. The method of claim 1 wherein after a predetermined period of time from the initial operation of said machine, said plank is maintained at a predetermined level during said continued operation of said machine by comparing the level of the plank to a level reference line and moving said plank upwardly and downwardly to maintain said plank at a level corresponding to said level reference line.

3. The method of claim 2 wherein said preventing upward and downward movement of said plank is stopped and said maintaining said plank at a predetermined level is initiated simultaneously after a predetermined period of time from the initial operation of said machine.

4. A travelling road construction machine comprising, means for depositing paving material in advance of a levelling and compacting plank for levelling and compacting the deposited paving material, a connecting member for connecting said plank to a levelling cylinder, said levelling cylinder being adapted to move said plank upwardly and downwardly relative to the deposited paving material by moving of said connecting member, a lift cylinder attached to said connecting member for permitting limited upward and downward movement of said plank during movement thereof over the deposited paving material, means acting on said lift cylinder for preventing downward movement of said plank when said machine is stopped and additional means acting on said lift cylinder for preventing both upward and downward movement of said plank for a selected period of time upon operation of said machine.

5. The travelling road construction machine of claim 4 further comprising, means for preventing movement of said levelling cylinder when said machine is stopped and means for activating said levelling cylinder upon operation of said machine simultaneous with operation of said lift cylinder to permit upward and downward movement of said plank.

6. The travelling road construction machine of claim 4 or claim 5 further comprising adjustable pressure relief means for permitting upward movement of said plank during said selected period of time in response to pressure acting on said plank in excess of a selected pressure provided on said adjustable pressure relief means.

* * * * *